US011250683B2

(12) United States Patent
Sundholm

(10) Patent No.: US 11,250,683 B2
(45) Date of Patent: Feb. 15, 2022

(54) SENSOR AND SYSTEM FOR MONITORING

(71) Applicant: MARICARE OY, Vantaa (FI)

(72) Inventor: Göran Sundholm, Tuusula (FI)

(73) Assignee: MARICARE OY, Vantaa (FI)

( * ) Notice: Subject to any disclaimer, the term of this patent is extended or adjusted under 35 U.S.C. 154(b) by 664 days.

(21) Appl. No.: 16/092,336

(22) PCT Filed: Apr. 19, 2017

(86) PCT No.: PCT/FI2017/050294
§ 371 (c)(1),
(2) Date: Oct. 9, 2018

(87) PCT Pub. No.: WO2017/182712
PCT Pub. Date: Oct. 26, 2017

(65) Prior Publication Data

US 2021/0217288 A1 Jul. 15, 2021

(30) Foreign Application Priority Data

Apr. 22, 2016 (FI) ..... 20165354

(51) Int. Cl.
*G08B 21/04* (2006.01)

(52) U.S. Cl.
CPC ..... *G08B 21/0469* (2013.01); *G08B 21/043* (2013.01); *G08B 21/0461* (2013.01)

(58) Field of Classification Search
None
See application file for complete search history.

(56) References Cited

U.S. PATENT DOCUMENTS 5,670,943 A * 9/1997 DiPoala ..... G08B 13/19 340/567
5,905,436 A * 5/1999 Dwight ..... G08B 21/0469 340/573.1

(Continued)

FOREIGN PATENT DOCUMENTS

CN 201364202 Y 12/2009
CN 102289911 A 12/2011

(Continued)

OTHER PUBLICATIONS

International Search Report (PCT/ISA/210) issued in PCT/FI2017/050294, dated Aug. 3, 2017.

(Continued)

*Primary Examiner* — Curtis J King
(74) *Attorney, Agent, or Firm* — Birch, Stewart, Kolasch & Birch, LLP

(57) ABSTRACT

A sensor and system for observing the presence, location, movement and/or attitude of one or more objects to be monitored includes a sensor detecting presence, location, movement and/or attitude. The sensor includes two detectors, which are adapted to measure in two measuring ranges that are at a different height, of which the measuring range of the first detector is a lower measuring range and the measuring range of the second detector is an upper measuring range. The sensor further includes a third detector, which is adapted to detect an item, such as a towel or clothing article, placed in front of and/or on top of the first detector, second detector and/or third detector.

19 Claims, 4 Drawing Sheets

(56) References Cited

U.S. PATENT DOCUMENTS

| | | | | |
|---|---|---|---|---|
| 6,127,926 | A | 10/2000 | Dando | |
| 6,377,174 | B1 | 4/2002 | Siegwart et al. | |
| 8,854,469 | B2 | 10/2014 | Hörbinger et al. | |
| 9,311,808 | B2 * | 4/2016 | Nurmela | A61B 5/1117 |
| 10,380,860 | B2 * | 8/2019 | Amir | G08B 21/0469 |
| 2003/0058111 | A1 * | 3/2003 | Lee | G08B 21/0423 340/573.1 |
| 2003/0058341 | A1 * | 3/2003 | Brodsky | G08B 21/043 348/169 |
| 2006/0145874 | A1 * | 7/2006 | Fredriksson | G08B 21/0461 340/573.1 |
| 2006/0176182 | A1 * | 8/2006 | Noguchi | B25J 13/08 340/573.1 |
| 2007/0194944 | A1 * | 8/2007 | Galera | F16P 3/14 340/686.6 |
| 2011/0050446 | A1 * | 3/2011 | Anderson | G01S 13/04 340/686.6 |
| 2013/0002434 | A1 * | 1/2013 | Cuddihy | G08B 21/043 340/573.7 |
| 2013/0100268 | A1 * | 4/2013 | Mihailidis | G08B 21/0492 348/77 |
| 2013/0128240 | A1 | 5/2013 | Yoshida et al. | |
| 2013/0240739 | A1 * | 9/2013 | Shpater | G02B 3/0043 250/353 |
| 2014/0035749 | A1 * | 2/2014 | Reed, Jr. | A61B 5/1115 340/573.4 |
| 2014/0122018 | A1 | 5/2014 | Sundholm et al. | |
| 2014/0340227 | A1 * | 11/2014 | Reed, Jr. | G08B 21/0469 340/573.1 |
| 2016/0140827 | A1 * | 5/2016 | Derenne | A61B 5/747 340/573.7 |
| 2017/0221335 | A1 * | 8/2017 | Brillaud | G08B 21/0469 |
| 2019/0130726 | A1 * | 5/2019 | Gustin | G08B 21/0461 |
| 2019/0202062 | A1 * | 7/2019 | Park | B25J 11/008 |
| 2020/0118410 | A1 * | 4/2020 | Lindstrom | A61B 5/1117 |

FOREIGN PATENT DOCUMENTS

| | | | |
|---|---|---|---|
| CN | 202105151 | U | 1/2012 |
| CN | 103295384 | A | 9/2013 |
| CN | 103761833 | A | 4/2014 |
| RU | 2198105 | C1 | 2/2003 |
| RU | 2235365 | C1 | 8/2004 |
| RU | 2468939 | C2 | 12/2012 |
| RU | 2013158344 | A | 7/2015 |
| WO | WO 97/01160 | A1 | 1/1997 |
| WO | WO 2008/121041 | A1 | 10/2008 |
| WO | WO 2009/143542 | A2 | 12/2009 |
| WO | WO 2010/045683 | A1 | 4/2010 |
| WO | WO 2013/060859 | A1 | 5/2013 |
| WO | WO 2013/150187 | A1 | 10/2013 |
| WO | WO 2014/147496 | A1 | 9/2014 |
| WO | WO 2015/030869 | A1 | 3/2015 |
| WO | WO 2015/101708 | A1 | 7/2015 |

OTHER PUBLICATIONS

English translation of Chinese Office Action and Search Report for Chinese Application No. 201780022978.X, dated Jan. 6, 2021.

English translation of Russian Office Action and Search Report, dated Jul. 8, 2020, for Russian Application No. 2018135706.

Chinese Office Action and Search Report for Chinese Application No. 201780022978.X, dated Mar. 25, 2020, with English translation.

Supplementary European Search Report for European Application No. 17785511.1, dated Nov. 29, 2019.

* cited by examiner

SENSOR AND SYSTEM FOR MONITORING

FIELD OF THE INVENTION

The invention relates to a sensor and to a system, by means of which persons in an area to be monitored can be observed and monitored.

BACKGROUND OF THE INVENTION

The monitoring of the condition of elderly people in a home environment is indispensable if it is desired to lengthen the possibility of an aging population coping in its home environment. Safety bracelet systems are widely used. Their weakness is that the user must wear the bracelet continuously and must be able to press the alarm button in an emergency. Bracelets that check the state of health also exist, but one of their problems is false alarms.

Prior art has also sought solutions in which a film that is of piezoelectric material is installed on the floor, which film registers pressure changes caused by movement on the surface of the floor. Also known in the art is the use of sensors to be installed on the floor, or under it, that detect the presence and movements of people without a change in pressure by means of capacitive sensors.

The possibility of using videocameras, movement detectors that are based e.g. on detecting infrared light, or e.g. ultrasound sensors, for monitoring the condition and state of elderly people is also presented in prior art.

For example, specification WO2012164169 discloses a method and a system known in the art that are based on ultrasound technology for tracking objects.

A drawback of observation and monitoring systems known in the art is that a user can easily cover the sensors performing the measuring, e.g. by inadvertently placing a towel or an article of clothing on top of a sensor, and in such a case the system no longer detects the movements of the user. Systems known in the art also do not issue an alarm about items in the measuring range of a sensor that prevent successful performance of the measurement.

BRIEF DESCRIPTION OF THE INVENTION

The sensor according to the invention is a sensor applicable to the detective measuring of the state and/or attitude of a person, and the system according to the invention comprises at least one such sensor. In the solution according to the invention the sensors can be installed e.g. on a ceiling, floor or wall. The solution according to the invention can be used e.g. for monitoring the condition and state of elderly people e.g. in their own homes or in retirement homes.

By using the sensor according to claim 1 and the system according to claim 10, the problems of the state of the art can be eliminated and an arrangement can be implemented that corresponds to the requirements according to usage needs. The invention is characterized by what is disclosed in the claims below.

In the solution according to the invention the sensor is a sensor detecting presence, location, movement and/or attitude, which sensor comprises two detectors, which are adapted to measure two measuring ranges that are at a different height. Of the measuring ranges, the measuring range of the first detector is the upper measuring range and the measuring range of the second detector is the lower measuring range. The sensor further comprises a third detector, which is adapted to observe an item, such as a towel or clothing article, placed in front of and/or on top of the first detector, second detector and/or third detector. In one embodiment of the invention the third detector detects an item placed in front of and/or on top of the third detector.

In one embodiment of the invention the third detector comprises a light source and at least one means, such as a phototransistor or photodiode, converting light into an electrical signal.

In one embodiment of the invention the light source and the means converting light into an electrical signal are arranged in such a way that the light coming from the light source is reflected to the means converting light into an electrical signal if an item is placed on top of the sensor and/or third detector.

In one embodiment of the invention the sensor comprises means for forming a sound and the sensor is adapted to issue an alarm with the means for forming a sound if it detects that an item has been placed in front of and/or on top of the first detector, second detector and/or third detector.

In one embodiment of the invention the system is adapted to issue an alarm, e.g. in the space to be monitored, and/or is adapted to send a notification if by means of the third detector of some sensor it is observed that an item has been placed in front of and/or on top of the first detector, second detector and/or third detector.

One advantage, among others, in the system according to the invention compared to earlier systems is that the system notices a situation in which a sensor has been covered. A sensor inadvertently covered in this way is noticed by the system and predetermined procedures can be carried out to rectify the situation, in which case the obstruction in the measuring range of the sensor can be removed as soon as possible.

BRIEF DESCRIPTION OF THE FIGURES

The invention is illustrated with the following drawings, of which

DETAILED DESCRIPTION OF THE INVENTION

In the solution of the invention, sensors to be installed e.g. on a wall or ceiling can be used, which sensors can detect the presence of an object by means of movement, heat or sound waves. The object can be e.g. an elderly person or some other person benefitting from supervision.

Figure 1A:
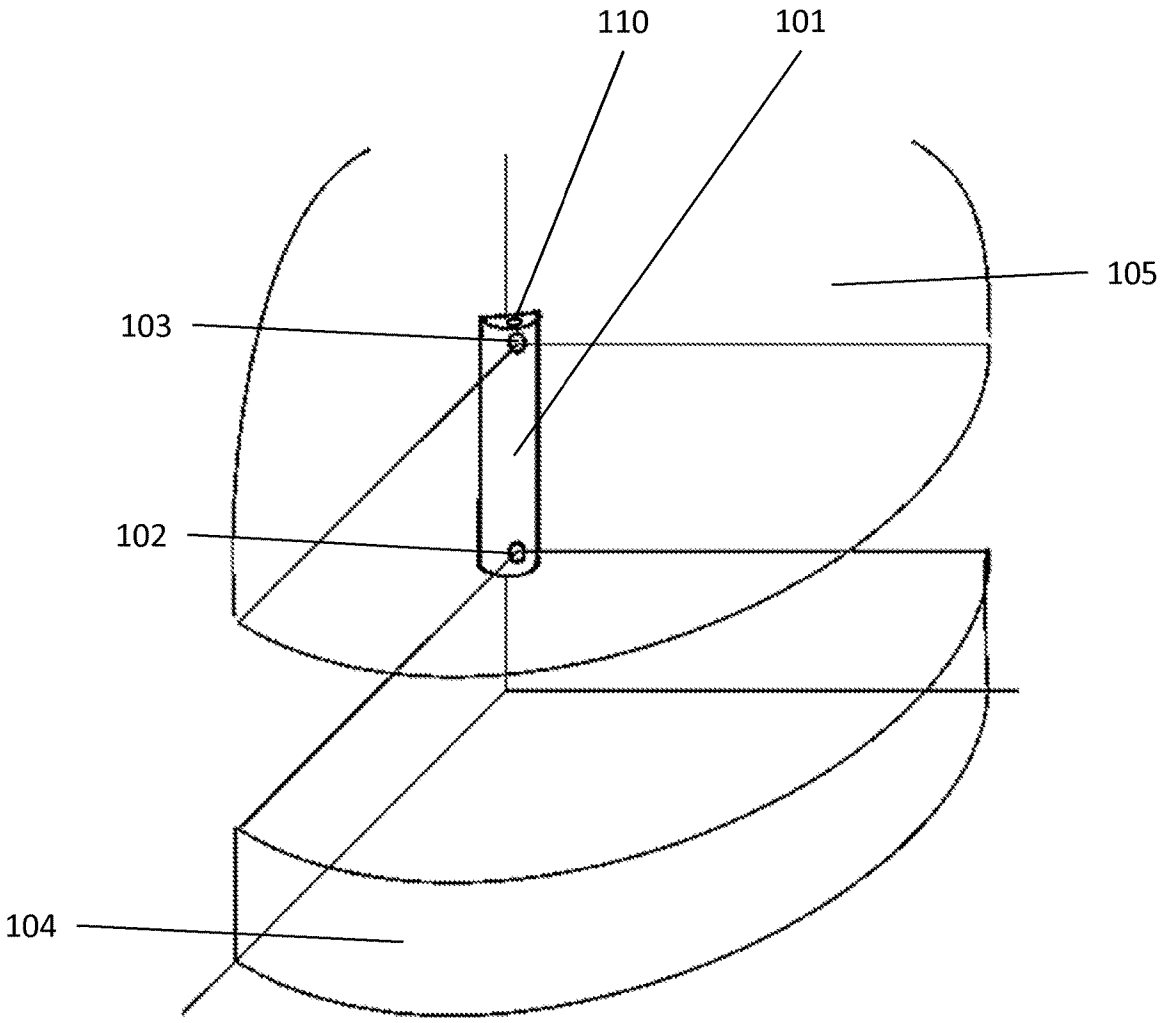
FIGS. 1A-C present a sensor according to an embodiment of the invention.
Figure 1B:
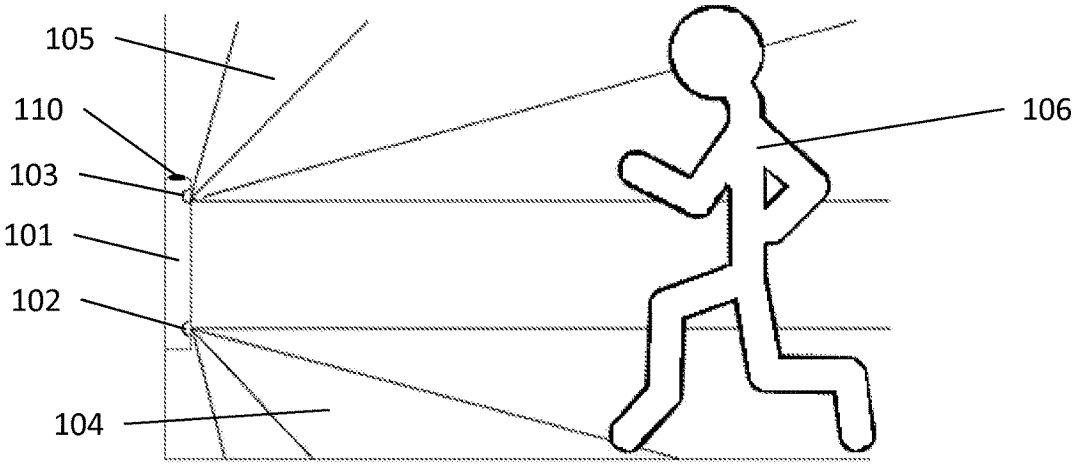
Figure 1C:
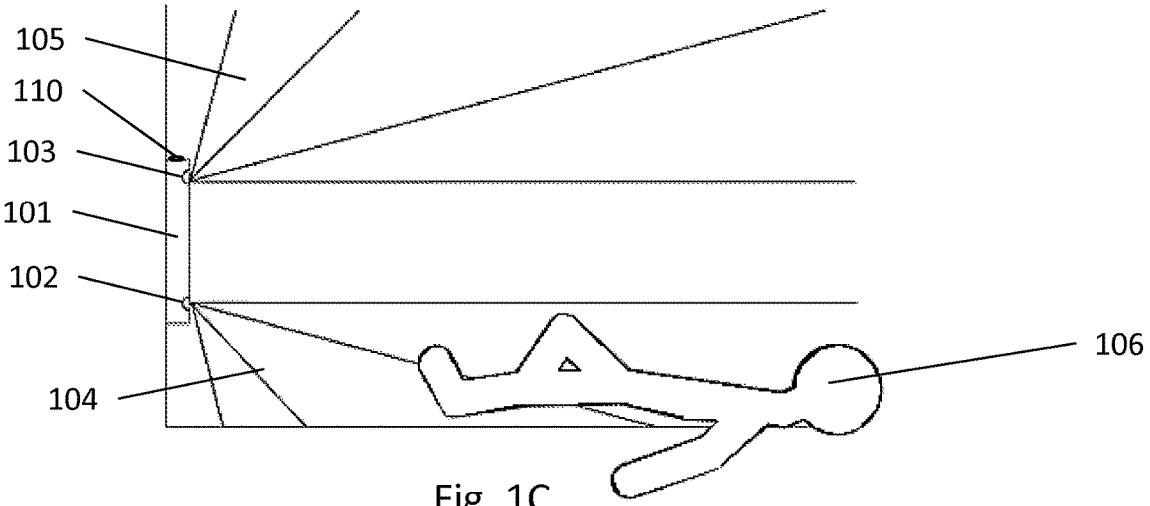

FIGS. 1A-C present a sensor according to an embodiment of the invention. The sensor 101 according to this embodiment is adapted to measure two sectors that are at a different height. The sensor 101 can be installed e.g., on a wall or in a corner of the space to be monitored, typically above the floor-level plane, e.g. at a height of approx. 40-50 cm from the floor. Corner installation suits the sensor well because its field of vision can be e.g. approx. 100 degrees on the horizontal plane. In one embodiment of the invention the sensor 101 has two motion detectors 102, 103, the field of vision of which is limited on the vertical plane in such a way that the measuring range 104 of the first detector 102 is limited to the bottom part of the area to be monitored and the measuring range 105 of the second detector 103 is limited to the top part of the area to be monitored. FIGS. 1B and 1C present as a cross-section the measuring ranges 104, 105 of the detectors 102, 103. In the solution of the invention it is good to arrange the measuring ranges of the detectors in such a way that the detector 103 monitoring the upper part of the area to be monitored detects a standing or upright moving person but not a person that is lying down or has fallen. In this way the system can distinguish an upright person from a person who has fallen e.g. in such a way that if an object 106 is detected with the upper detector, it is interpreted that the person is upright but if an object 106 is not detected with the upper detector and the object 106 is detected with the lower detector, it can be interpreted that the person has fallen. In one embodiment of the invention between the measuring ranges 104, 105 of the first detector 102 and the second detector 103 remains a vertical area, which does not belong to the measuring range of either detector.

The motion detectors 102, 103 of the sensor 101 can be e.g. passive infrared sensors (PIR), ultrasound sensors, microwave sensors or combined sensors, such as a combination of a passive infrared sensor and a microwave sensor or a combination of two passive infrared sensors. The detectors of the sensor 101 can also be implemented with other technologies, by means of which the sensor is adapted to measure the presence and/or movement of an object in two different measuring ranges 104, 105 in the height direction.

The sensor 101 according to the invention further comprises a third detector 110, which is adapted to observe an item, such as a towel or clothing article, placed in front of and/or on top of the first detector 102, second detector 103 and/or third detector 110. In this way the sensor can detect if an item is placed in front of and/or on top of its upper measuring range 105 and/or its lower measuring range 104. In the embodiment of FIGS. 1A-1C the third detector 110 is arranged in essentially the top part of the sensor and/or above the first detector 102 and second detector 103.

In one embodiment of the invention the third detector 110 comprises a light source and at least one means converting light into an electrical signal. The means converting light into an electrical signal can be e.g. a phototransistor or photodiode. The light source can be a light source functioning in the infrared wavelength range. The light source can be a LED light source. The light source and the means converting light into an electrical signal can be arranged in such a way that the light coming from the light source is reflected to the means converting light into an electrical signal if an item is placed on top of the sensor and/or third detector.

In one embodiment of the invention the third detector comprises two light sources, which are adapted to flash alternately.

The sensor and/or the system can detect by means of the third detector an item left on top of a sensor and/or in the measuring range of the detectors e.g. in such a way that the third detector detects an item placed on top of or in the proximity of the third detector. In the embodiment of the invention in which the third detector 110 comprises a light source and at least one means converting light into an electrical signal, the light produced by the light source is reflected from an object placed on top of the third detector to the means converting light into an electrical signal, in which case the presence of an object on top of the third sensor can be detected.

In one embodiment of the invention the sensor comprises means for forming a sound, such as e.g. a loudspeaker, and the sensor is adapted to issue an alarm with the means for forming a sound if it detects that an item has been placed in front of and/or on top of the first detector, second detector and/or third detector.

In the solution according to the invention the system comprises at least one sensor and can further comprise measuring electronics producing sensor observations by means of the sensors, and a processor applicable to processing the sensor observations, and a central unit comprising a memory, which central unit is e.g. a data processing device. The system can have a central unit, which can manage one or more sensors or sensor groups, wherein one sensor group means e.g. the sensors in the same space, such as in the same room.

The processor, central unit and/or measuring electronics can be integrated into the sensors or they can be disposed separately or in separate units. In the embodiment described in FIGS. 1A-1C the program executed by the processor can interpret the movements observed in the top parts and bottom parts of the space being monitored and can give an alarm if the alarm conditions defined for the program are fulfilled.

The system according to the invention can issue an alarm signal in the space to be monitored if by means of the third detector of some sensor an item is observed in front of and/or on top of the first detector, second detector and/or third detector of the sensor in question.

In one embodiment of the invention the system stops issuing an alarm signal when an item in front of and/or on top of the first detector, second detector and/or third detector of the sensor in question is no longer detected by means of the third detector. The duration of the alarm signal can also be of a predetermined length. The alarm signal can be e.g. a sound signal and/or a light signal.

In one embodiment of the invention the system is adapted to send a notification if by means of the third detector of some sensor it is observed that an item has been placed in front of and/or on top of the first detector, second detector and/or third detector.

The falling of a person can also be detected with the sensor according to the invention. A sensor measuring two different height ranges can interpret the falling of an object e.g. according to the following conditions:

1. If movement is detected in the area to be monitored, go to item 2.
2. If movement is detected only in the bottom part of the area to be monitored, go to item 3.
3. Wait for a predetermined time, e.g. 30-180 seconds. If during this time movement is not detected in the top part of the area to be monitored, go to item 4. If movement is detected in the top part of the area to be monitored, go to item 1.
4. It is interpreted that a person has fallen, go to item 1.

Furthermore, the system can send a notification of a fall if a person is interpreted as having fallen.

In one embodiment of the invention only some of the sensors of the area to be monitored have the functionality enabling the issuing of an alarm signal as described above. For example, the sensors in only some rooms, such as in the living room, can be provided with this functionality and the sensors in other rooms send a notification onwards immediately after detecting the covering of a sensor or a falling event. In one embodiment of the invention only some of the sensors in one space, such as in a room, comprise the functionality enabling the issuing of an alarm signal as described above.

In the system there can also be a control center and the predetermined information concerning the presence, location, movement and/or attitude of the object can be sent to the control center. The alarm terms used by the system can be changed, e.g. on the basis of presence information received from an RFID reader. A notification can be sent or an alarm can be given e.g. to an external alarm system or wirelessly to a central server of the system, from which server the alarm is directed onwards.

The system can also have a memory means, in which the system is adapted to record a measurement signal, or information derived from it, for observing the chronological dependency of the area being monitored and the behavior of objects. By means of this the system can give an alarm e.g. if a person being monitored has not got out of bed or visited the kitchen for a certain time, or if the person has gone to the toilet too often. The memory means also enables learning of a more common daily rhythm and the detection of aberrations occurring in it.

An area to be monitored with sensors can be the whole area or only a part of some area. The area to be monitored can be composed e.g. of one or more rooms and certain parts of the area, e.g. fixed installations such as cupboards, can be left outside the area to be monitored.

In some applications it is advantageous to first perform a charting of the unchanged area, i.e. to chart the measuring information of the sensors when mainly unmoving and unchanging objects and structures are in place. This type of situation is e.g. in a residential apartment when the furniture is in position but there are no people, pets or robots in the apartment. This charted information can be recorded in the system, e.g. in a memory that is located in the central unit or in a memory means that is in connection via a data network, which memory means can be e.g. in a control center or service center. For this purpose memory means must be comprised in the arrangement, which memory means can be in the central unit or connected to it via a data network.

According to one embodiment of the invention the system performs a charting of the unchanged area continuously or at defined intervals, in which case the system is able to detect e.g. changes in the area caused by new furniture or by changes in the location of furniture. In this way the system is able to adapt gradually to changes occurring in the area to be monitored.

By means of the sensors of the system the movements of an object can be checked. For the purposes of this function the central unit of the system comprises the necessary software and information about the characteristic properties of the signals being detected. Generally the central unit can deduce information from a signal received via a sensor, e.g. about the location, speed, movement direction, state or attitude of an object.

Generally, at least some of the sensors of the system are disposed in the proximity of those types of surfaces, or on the surfaces, such as e.g. floor surfaces, wall surfaces, door surfaces or ceiling surfaces of an apartment, of the area to be monitored to which, or into the proximity of which, the object has access.

Figure 2:
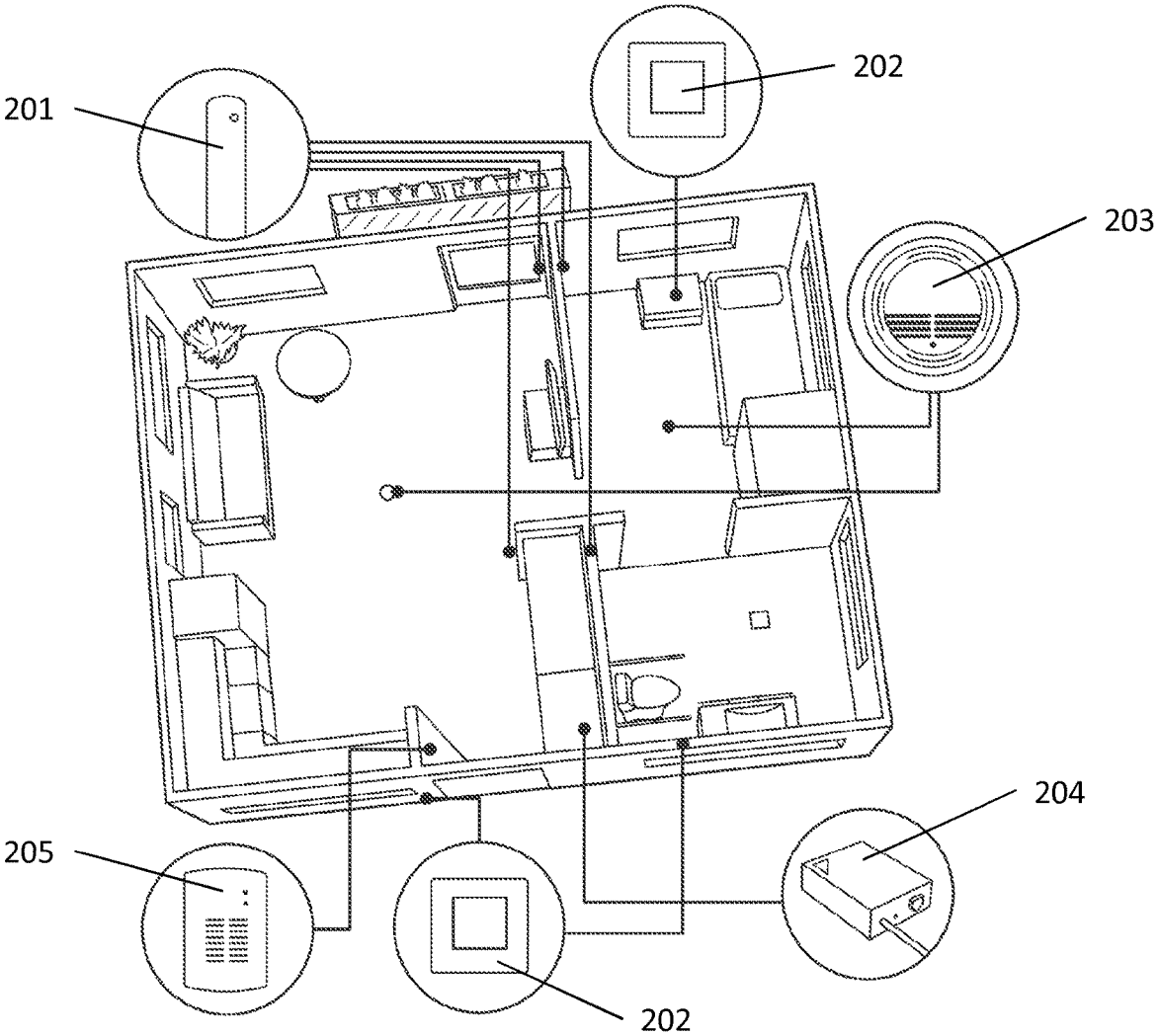
FIG. 2 presents the components of an embodiment of the system according to the invention, in the area to be monitored.

FIG. 2 presents the components of an embodiment of the system according to the invention in the area to be monitored. The sensor 201 or sensors to be used in the invention are disposed in connection with the area to be monitored in such a way that by means of the sensor 201 or sensors the area to be monitored can be monitored. A sensor can be e.g. a fall detector and it can be disposed in any apartment whatsoever. If sensors to be installed on top of a surface, e.g. a wall, floor or ceiling surface, are used they can be fastened to the surface e.g. with double-sided tape or with a sticker strip, in which case they can easily be removed. The sensors 201 can be connected wirelessly or by wireline to a gateway 204, which collects measured values obtained from the sensors 201 or status information formed by the sensors 201, e.g. about the covering of a sensor, the objects detected, the state of health of the objects and/or the attitudes of the objects. The gateway 204 sends the information onwards e.g. to a control center or to another body that supervises the area and/or the objects therein. The transfer of information between the system and some recipient can be performed e.g. using a phone connection, a wireline broadband connection or wireless connections. It is advantageous in the data transfer to take into account issues relating to data security and privacy, which many official regulations also address.

In one embodiment of the invention the sensor 201 or sensors comprise their own central unit and the central unit of a sensor is in connection with the gateway 204. In a second embodiment of the invention the central units of the sensor 201 or sensors are integrated into a gateway 204.

It is possible that some of the functions of the central unit or of the gateway 204 are performed elsewhere via a data network connection, e.g. in a central control room or service center.

According to one embodiment of the invention an alarm signal given by the system and lasting a predetermined period of time in the space being monitored, which alarm signal can be given if it is detected that the sensor has been covered and/or e.g. before the sending of a notification of a fall, can be given via a light alarm unit and/or a sound alarm unit of the system. The light alarm unit and/or sound alarm units can be in each different part, e.g. room, of the premises. This functionality can also be integrated into the sensors, e.g. into all the sensors or only some of the sensors.

The system according to the invention can also comprise a call pushbutton 202, after the pressing of which the system can form a connection e.g. to nursing personnel, security personnel or it can perform various alarm procedures. The call pushbutton can be wireless and it can be adapted to function without batteries.

The notification procedures and alarm procedures according to the system of the invention can include e.g. the starting of alarm indication signaling (buzzer, light, siren, alarm clock), making contact with an alarm center or service center, a care provider or a relative. In some cases, an alarm can also be given directly to the person being monitored or to the user, e.g. by means of speech synthesis or a speech recording. For performing these tasks the arrangement can comprise means needed for processing time data, such as e.g. a clock circuit.

The system according to the invention can also comprise fire detectors 203, which can be in connection with another system via a wireline or wireless connection. If the fire detectors 203 warn of a fire, alarm procedures can be performed, e.g. by sending an alarm message to a control center or to the rescue authorities.

Figure 3:
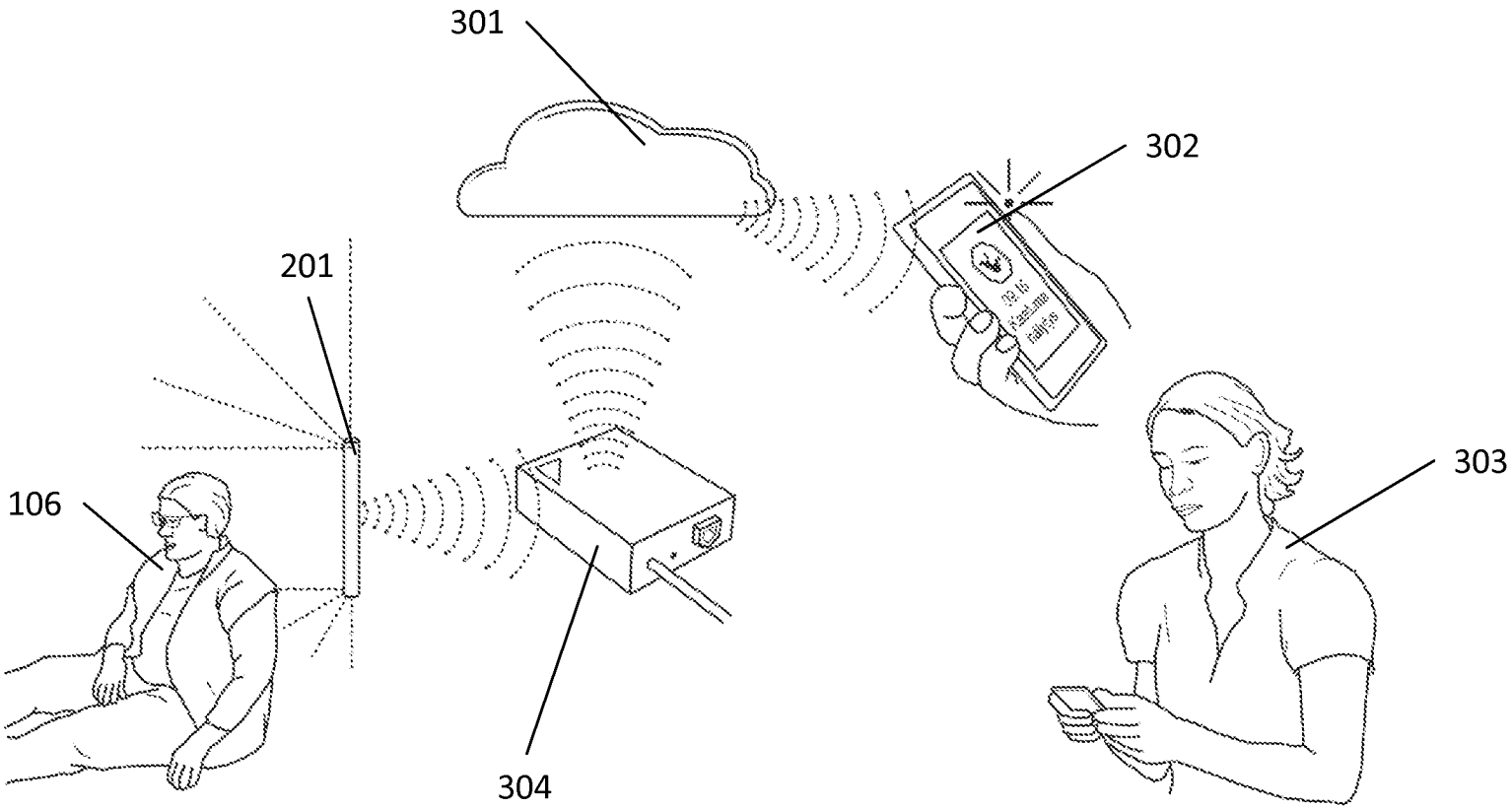
FIG. 3 presents the operation of an embodiment of the system according to the invention.

FIG. 3 presents the operation of an embodiment of the system according to the invention, in which the state of health or attitude of a person 106 in the area being monitored is monitored. If by means of the third detector of some sensor 201 an item is observed in front of and/or on top of the first detector, second detector and/or third detector of the sensor in question, the system can issue an alarm signal in the area being monitored. The issuing of an alarm signal can be stopped when the item in front of and/or on top of the first detector, second detector and/or third detector of the sensor in question is no longer detected by means of the third detector. In such a case the obstruction to measuring the sensor has been removed. The duration of the alarm signal can, in one embodiment of the invention, be of a predetermined length. The alarm signal can be e.g. a sound signal and/or a light signal.

In one embodiment of the invention the system can send a notification if by means of the third detector of some sensor 201 it is observed that an item has been placed in front of and/or on top of the first detector, second detector and/or third detector. If the sensors 201 of the system detect that an object 106 in the area being monitored has fallen, the system can send a notification of a fall.

In one embodiment of the invention the system examines the information measured by a number of sensors, e.g. by all the sensors in the area being monitored, and a notification of a fall is only sent if no sensor at all in the upper measuring range detects any objects at all.

In the situation in the embodiment presented in FIG. 3, in which the system sends a message e.g. because of the covering of a sensor or because of the falling of an object, the sensor 201 sends the information about the situation to the gateway 304 of the system and the gateway 304 sends the information and/or an alarm onwards to the server 301 e.g. via an Internet connection or via some other connection. From the server 301 the information and/or alarm is sent to a body monitoring the health of the person, e.g. as a message to a phone 302, as an alarm and/or e.g. to a nurse 303, to relatives or to an emergency center. In this way e.g. information about the covering of a sensor and/or about the falling of the person reaches the necessary people or organizations and the person who fell receives help as quickly as possible. In one embodiment of the invention the system can send information directly from the gateway 304 to a body monitoring the health of the person.

In one embodiment of the invention the third detector is a camera. In this embodiment the camera can be connected to a sensor and/or to the system by means of a wired or wireless connection but otherwise arranged separately from the sensor detecting the presence, location, movement and/or attitude of an object.

It is obvious to the person skilled in the art that the different embodiments of the invention are not limited solely to the examples described above, and that they may therefore be varied within the scope of the claims presented below. The characteristic features possibly presented in the description in conjunction with other characteristic features can also, if necessary, be used separately to each other.

The invention claimed is:

1. A sensor for observing the presence, location, movement and/or attitude of an object being monitored, wherein the sensor is a sensor detecting presence, location, movement and/or attitude, the sensor comprising two detectors adapted to measure in two measuring ranges that are at a different height, of which the measuring range of the first detector is a lower measuring range and the measuring range of the second detector is an upper measuring range, wherein the sensor further comprises a third detector, which is adapted to observe an item placed in front of and/or on top of the first detector, second detector and/or third detector, and wherein the third detector is arranged in a top part of the sensor and/or above the first detector and second detector.

2. The sensor according to claim 1, wherein the third detector comprises at least one light source and at least one mechanism for converting light into an electrical signal.

3. The sensor according to claim 2, wherein the light source and the mechanism for converting light into an electrical signal are arranged in such a way that the light coming from the light source is reflected to the mechanism for converting light into an electrical signal, if an item is placed on top of the sensor and/or third detector.

4. The sensor according to claim 2, wherein the third detector comprises two light sources adapted to flash alternately.

5. The sensor according to claim 2, wherein the light source is a light source functioning in the infrared wavelength range.

6. The sensor according to claim 2, wherein the light source is a LED light source.

7. The sensor according to claim 1, wherein the sensor comprises mechanism for forming a sound and the sensor is adapted to issue an alarm with the mechanism for forming a sound, if the sensor detects that an item has been placed in front of and/or on top of the first detector, second detector and/or third detector.

8. The sensor according to claim 7, wherein the sensor is adapted to stop issuing an alarm when the item in front of and/or on top of the first detector, second detector and/or third detector of the sensor in question is no longer detected by the third detector.

9. A system for observing the presence, location, movement and/or attitude of one or more objects to be monitored in the area to be monitored, wherein the system comprises at least one sensor according to claim 1, wherein the sensor or sensors are fitted into some part of the area to be monitored.

10. The system according to claim 9, wherein the system is adapted to issue an alarm signal in the area to be monitored, if by means of the third detector of some sensor an item is observed in front of and/or on top of the first detector, second detector and/or third detector of the sensor in question.

11. The system according to claim 10, wherein the system is adapted to stop issuing an alarm signal when the item in front of and/or on top of the first detector, second detector and/or third detector of the sensor in question is no longer detected by the third detector.

12. The system according to claim 10, wherein the duration of an alarm signal is of a predetermined length.

13. The system according to claim 10, wherein the alarm signal is a sound signal and/or a light signal.

14. The system according to claim 9, wherein the system is adapted to send a notification if by means of the third detector of some sensor it is observed that an item has been placed in front of and/or on top of the first detector, second detector and/or third detector.

15. The system according to claim 9, wherein the system is adapted to interpret a person as having fallen if an object is not detected in the upper measuring range and an object is detected in the lower measuring range, and wherein the system is further adapted to send a notification of a fall if a person is interpreted as having fallen.

16. The system according to claim 14, wherein the notification and/or fall notification is the sending of an alarm or message to the body monitoring the health of the object to relatives or to an emergency center.

17. The system according to claim 9, wherein the system is adapted to send information derived from the object onwards using a wireline or wireless telecommunications connection.

18. The sensor according to claim 2, wherein the mechanism for converting light into an electrical signal is a phototransistor or photodiode.

19. The sensor according to claim 3, wherein the third detector comprises two light sources, which are adapted to flash alternately.

* * * * *